US008182656B2

(12) United States Patent
Kitsuka et al.

(10) Patent No.: US 8,182,656 B2
(45) Date of Patent: May 22, 2012

(54) ELECTROLYZING DEVICE

(75) Inventors: Kenta Kitsuka, Gunma (JP); Hironobu Sekine, Gunma (JP); Tomohito Koizumi, Gunma (JP); Mineo Ikematsu, Ibaraki (JP); Masahiro Iseki, Saitama (JP)

(73) Assignee: Sanyo Electric Co., Ltd., Osaka (JP)

( * ) Notice: Subject to any disclaimer, the term of this patent is extended or adjusted under 35 U.S.C. 154(b) by 887 days.

(21) Appl. No.: 12/206,994

(22) Filed: Sep. 9, 2008

(65) Prior Publication Data

US 2009/0065352 A1 Mar. 12, 2009

(30) Foreign Application Priority Data

Sep. 11, 2007 (JP) ..... 2007-235175
Jul. 17, 2008 (JP) ..... 2008-186404
Aug. 25, 2008 (JP) ..... 2008-215018

(51) Int. Cl.
*B23H 7/14* (2006.01)
*B25H 7/04* (2006.01)
*B01D 61/00* (2006.01)

(52) U.S. Cl. ..... 204/230.7; 204/229.7; 204/525

(58) Field of Classification Search ..... 204/230.7, 204/229.7, 525
See application file for complete search history.

(56) References Cited

U.S. PATENT DOCUMENTS 5,608,358 A * 3/1997 Iseki et al. ..... 331/65
5,954,937 A * 9/1999 Farmer ..... 205/687
6,045,704 A * 4/2000 Sato et al. ..... 210/694
2008/0093213 A1 * 4/2008 Yamamoto et al. ..... 204/235

FOREIGN PATENT DOCUMENTS

JP 6-165985 6/1994
JP 2003-24943 1/2003

* cited by examiner

*Primary Examiner* — Lore Jarrett
(74) *Attorney, Agent, or Firm* — McDermott Will & Emery LLP

(57) ABSTRACT

An electrolyzing device is capable of removing scales adhered to a cathode in an electrolyzing mode without deteriorating an electrode forming an anode.

An electrolyzing device includes a first main electrode 3, a second main electrode 4, an auxiliary electrode 5, and control means C for controlling current supply to the electrodes, the control means C includes an electrolyzing mode in which treated water is electrochemically treated by using the first main electrode 3 as an anode and the second main electrode 4 as a cathode, a scale removal mode of the second main electrode in which scales adhered to the second main electrode 4 are removed by using the second main electrode 4 as the anode and the auxiliary electrode 5 as the cathode, and a scale removal mode of the auxiliary electrode in which scales adhered to the auxiliary electrode 5 are removed by using the auxiliary electrode 5 as the anode and the second main electrode 4 as the cathode.

13 Claims, 11 Drawing Sheets

ELECTROLYZING DEVICE

BACKGROUND OF THE INVENTION

The present invention relates to an electrolyzing device for electrolyzing treated water in terms of an electrochemical method, and more particularly, to an electrolyzing device capable of efficiently removing scales adhered to an electrode forming a cathode when a tap water corresponds to the treated water.

In the past, there is known an ionized water forming device for forming alkaline ionized water or acid ionized water by electrolyzing water in such a manner that at least a pair of electrodes is immersed in the water, a barrier membrane is provided therebetween, and electric current flows between the electrodes (for example, see Japanese Patent Application Laid-Open No. H06-165985). Besides, there is known an electrolyzing device for forming hypochlorous acid, ozone, etc. in treated water by treating a tap water as the treated water containing at least chloride ion in terms of an electrochemical method, for example, in such a manner that at least a pair of electrodes is immersed in the water and electric current flows between the electrodes to perform an electrolyzing treatment (for example, see Japanese Patent Application Laid-Open No. 2003-24943).

Since calcium ion or magnesium ion is contained in the electrolyzed tap water, scales mainly containing the calcium or the magnesium are adhered to a surface of an electrode forming a cathode while electric current flows between the electrodes. When the precipitation of the scales grows, the surface of the electrode forming the cathode is covered with the scales, and an area functioning as the electrode becomes narrow, thereby causing a problem in that electrolyzing efficiency deteriorates. Then, when the electrodes are adjacently arranged, a flow passage is blocked due to a lamination of the scales formed between the electrodes, thereby causing a problem in that it is difficult to form electrolyzed water.

Therefore, in general, the scales adhered to the electrode are removed by changing the polarity of the electrode whenever the electrolyzing treatment is carried out for a predetermined time.

Meanwhile, as an electrode used for the electrolyzed water forming device, electrodes exhibiting various functions have been developed. For example, as an electrode having a large ozone forming potential, electrodes of which a surface functioning as a catalyst mainly contains dielectric material such as tantalum oxide have been developed. The electrolyzed water forming device performs an electrochemical treatment to the tap water as the treated water by applying a positive potential to one electrode and applying a negative potential to the other electrode made of insoluble metal. Accordingly, ozone is high-efficiently formed by the electrode having a surface layer functioning as a catalyst, that is, the anode.

However, in this case, when the scales of the insoluble electrode forming the cathode are removed by changing the polarity, the electrode having the surface layer functioning as the catalyst is changed to the cathode. Accordingly, the surface layer mainly containing the dielectric material is destroyed and broken, and the surface layer is apparently separated. For this reason, the durability of the electrode having the surface layer apparently reduces, thereby causing a problem in that an ozone forming function during a general electrolyzation apparently reduces.

Accordingly, it is necessary to remove the scales adhered to the surface of the other electrode during the electrolyzation without using the electrode as the cathode. As such a method, it may be supposed that an acid cleaning is carried out by using a medical agent or a physical scale removal is carried out. However, in this case, a problem arises in that a medical agent management or system becomes complex.

SUMMARY OF THE INVENTION

Therefore, the present invention is contrived in consideration of the above-described problems, and an object of the invention is to provide an electrolyzing device capable of removing scales adhered to a cathode in an electrolyzing mode without deteriorating an electrode forming an anode.

According to a first aspect of the invention, there is provided an electrolyzing device including: first and second main electrodes; an auxiliary electrode; and control means for controlling current supply to the electrodes, wherein the first main electrode is an electrode deteriorating upon being used as a cathode, wherein the control means includes an electrolyzing mode in which treated water is electrochemically treated by using the first main electrode as an anode and the second main electrode as the cathode, a scale removal mode of the second main electrode in which scales adhered to the second main electrode are removed by using the second main electrode as the anode and the auxiliary electrode as the cathode, and a scale removal mode of the auxiliary electrode in which scales adhered to the auxiliary electrode are removed by using the auxiliary electrode as the anode and the second main electrode as the cathode.

A second aspect of the invention provides the electrolyzing device according to the first aspect, wherein in the scale removal mode of the second main electrode, an anode current flowing to the first main electrode is smaller than that flowing to the second main electrode.

A third aspect of the invention provides the electrolyzing device according to the first aspect, wherein in the scale removal mode of the auxiliary electrode, an anode current flowing to the first main electrode is smaller than that flowing to the auxiliary electrode.

A fourth aspect of the invention provides the electrolyzing device according to any one of the first to third aspects, wherein the second main electrode is disposed between the first main electrode and the auxiliary electrode.

A fifth aspect of the invention provides the electrolyzing device according to any one of the first to fourth aspects, wherein the auxiliary electrode has a smaller area contributing to electrolyzation than those of the first and second main electrodes.

According to the electrolyzing device of the invention, it is possible to remove the scales adhered to the cathode in the electrolyzing mode without deteriorating the electrode forming the anode.

DETAILED DESCRIPTION OF THE PREFERRED EMBODIMENT

Hereinafter, an electrolyzing device according to a preferred embodiment of the invention will be described with reference to the accompanying drawings.

First Embodiment

Figure 1:
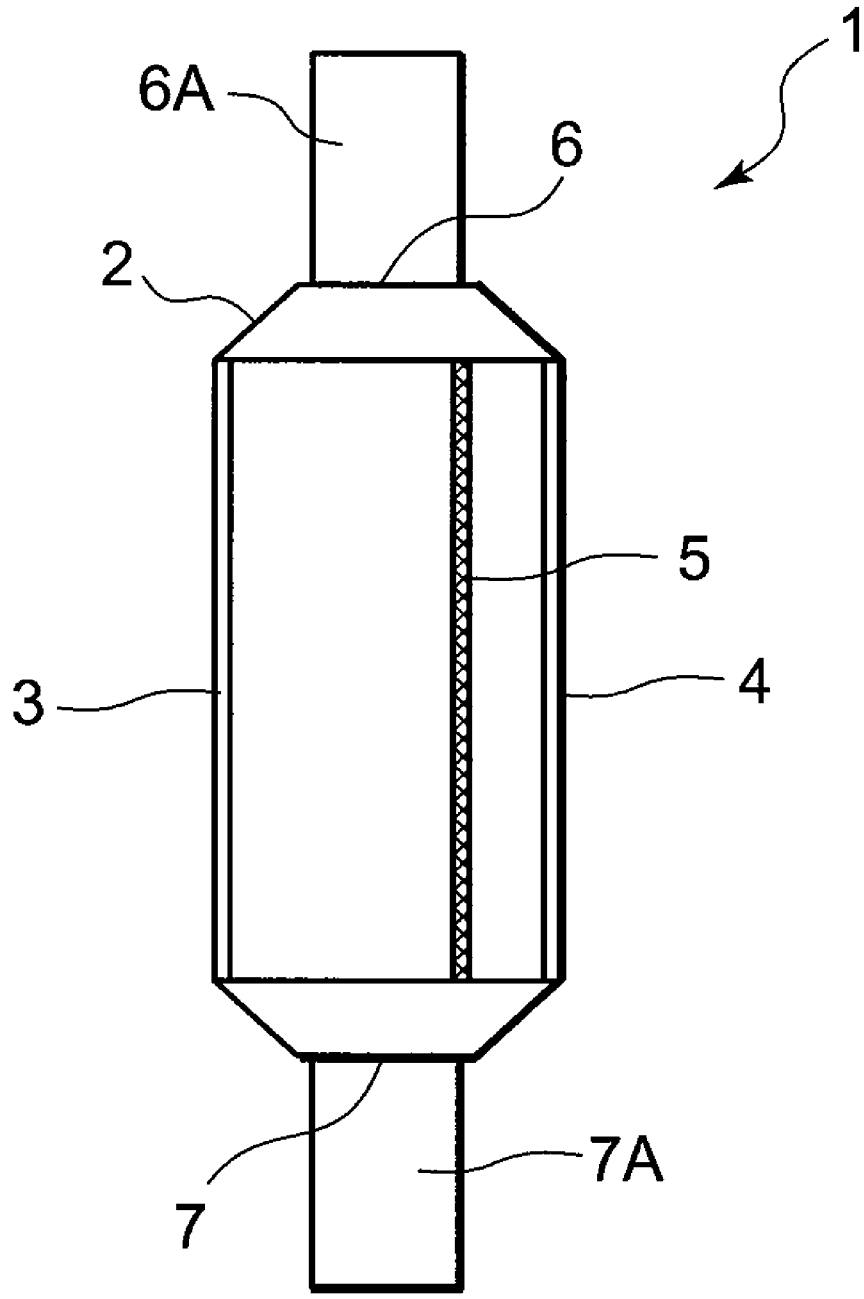
FIG. 1 is a schematic configuration diagram showing an electrolyzing device as an example of an electrolyzing device according to the invention.
Figure 2:
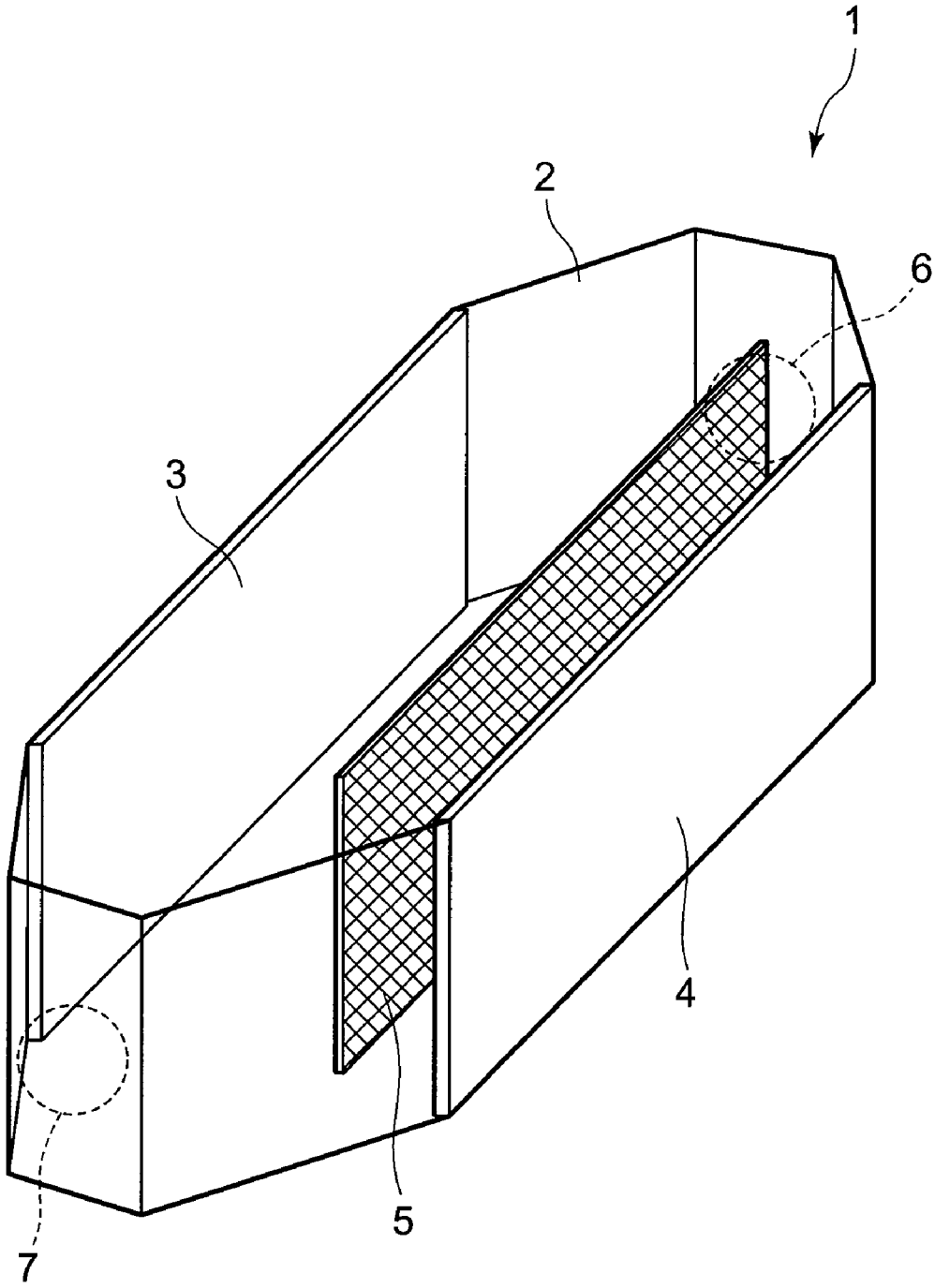
FIG. 2 is a schematic perspective view showing the electrolyzing device in FIG. 1.
Figure 3:
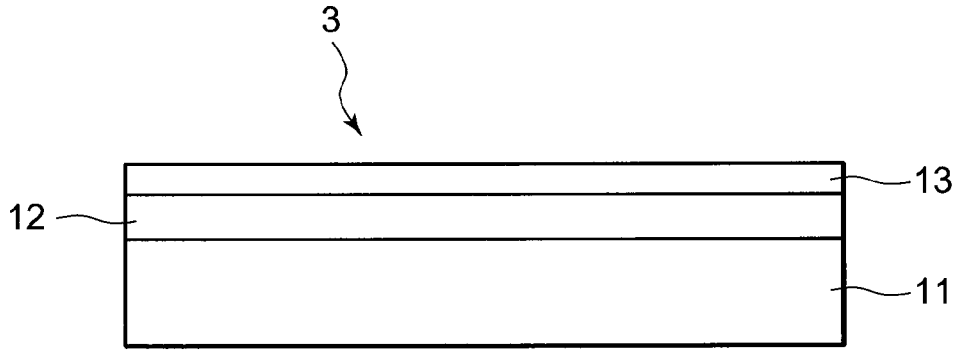
FIG. 3 is a schematic top view showing a first main electrode.
Figure 4:
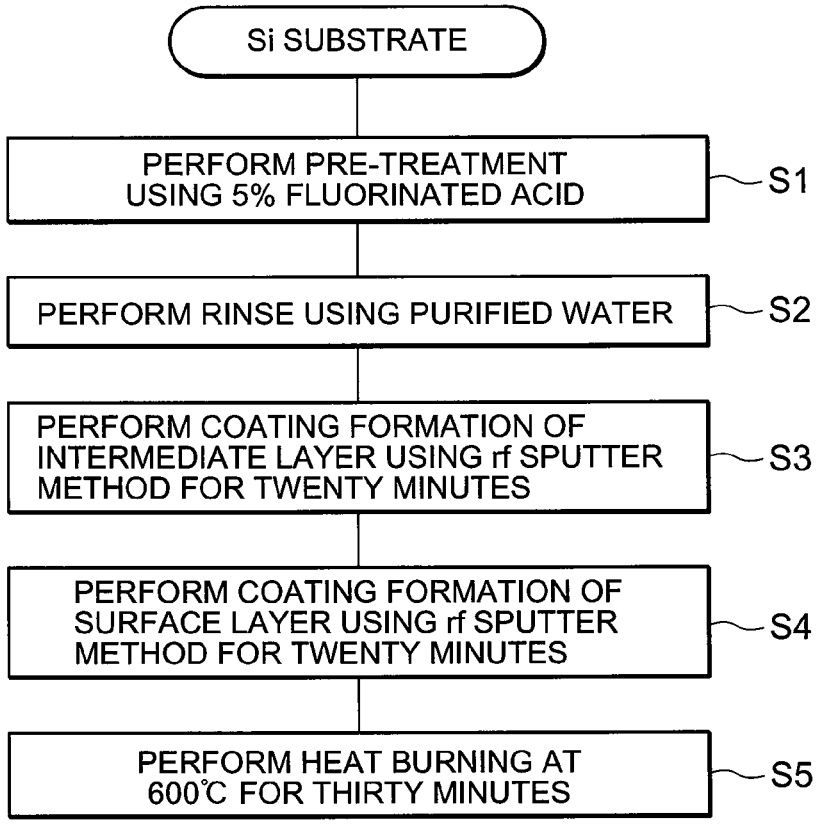
FIG. 4 is a flowchart showing a method of manufacturing the first main electrode.
Figure 5:
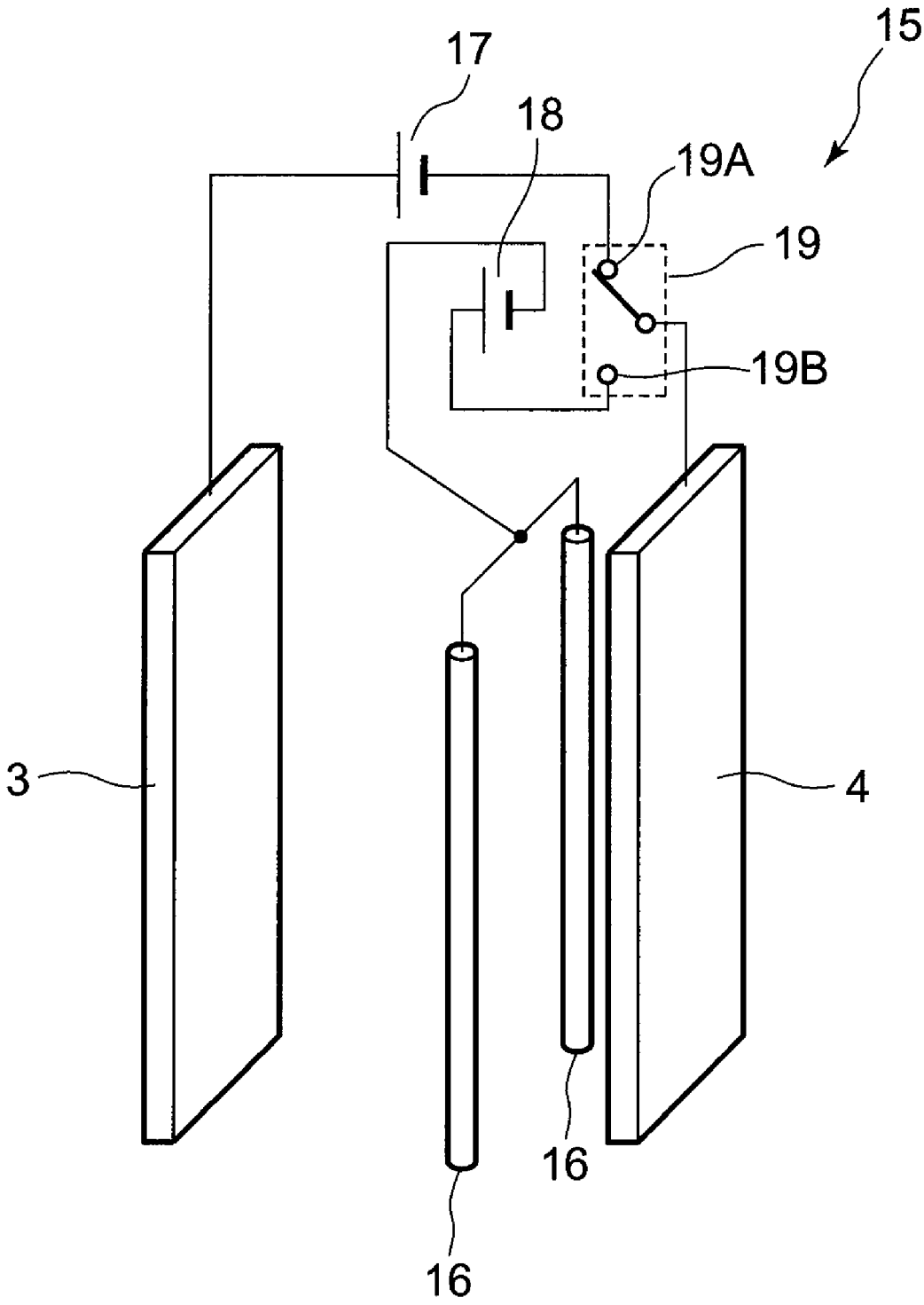
FIG. 5 is a schematic configuration diagram showing an electrolyzing device as another example.
Figure 6:
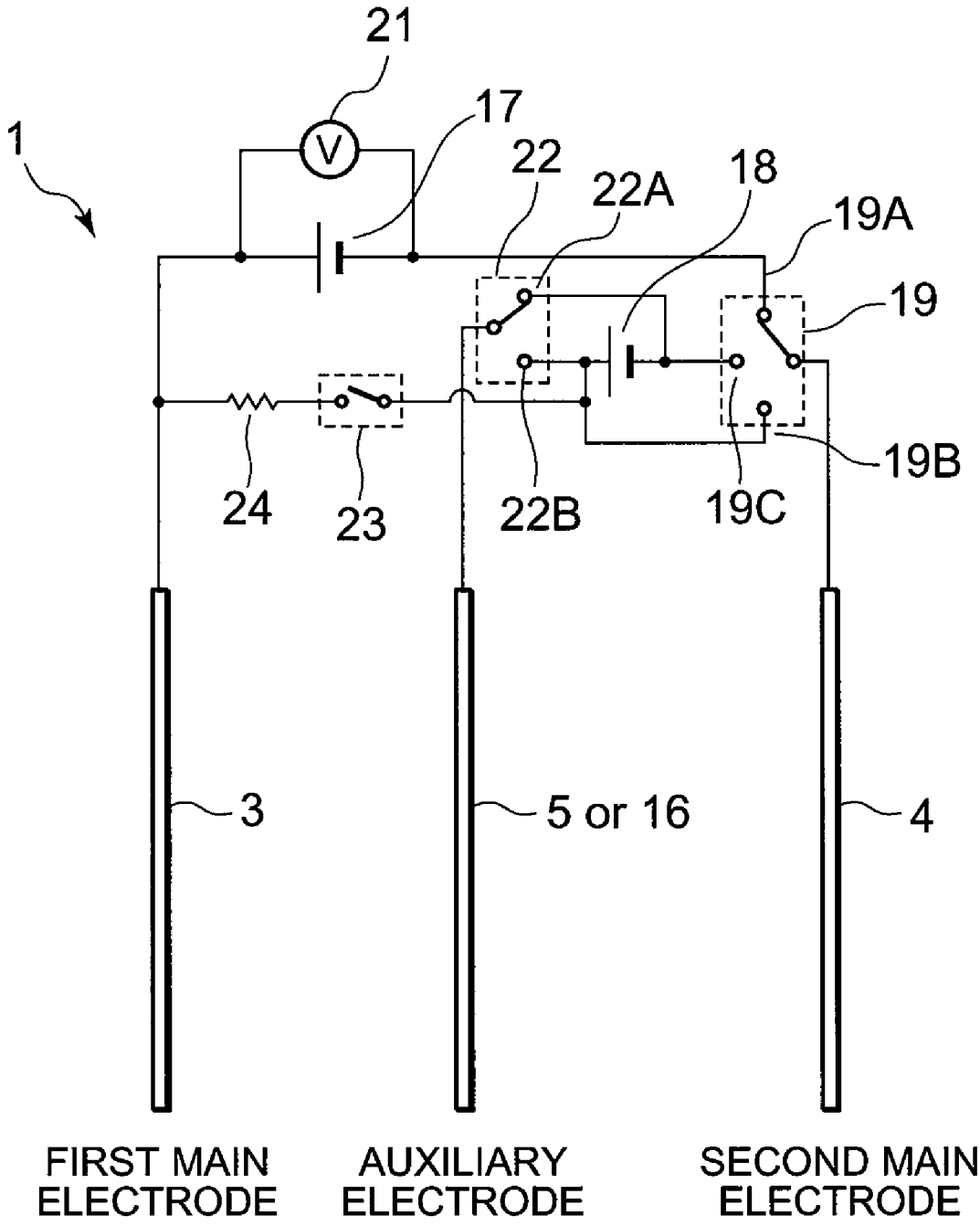
FIG. 6 is a schematic configuration diagram showing a state of the electrolyzing device in an electrolyzing mode.
Figure 7:
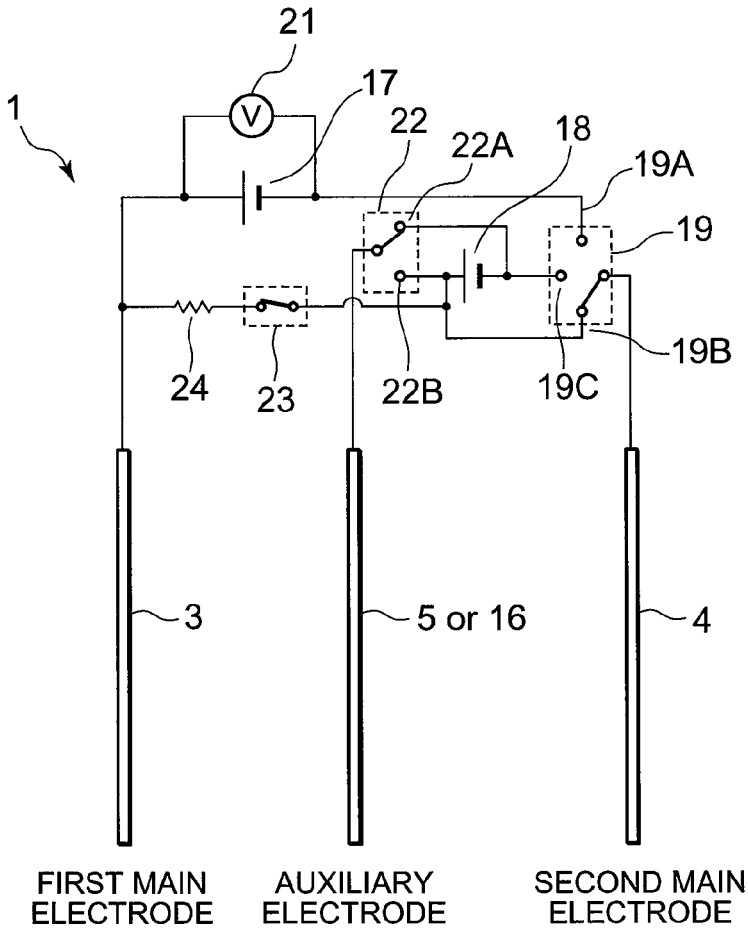
FIG. 7 is a schematic configuration diagram showing a state of the electrolyzing device in a scale removal mode of a second main electrode.
Figure 11:
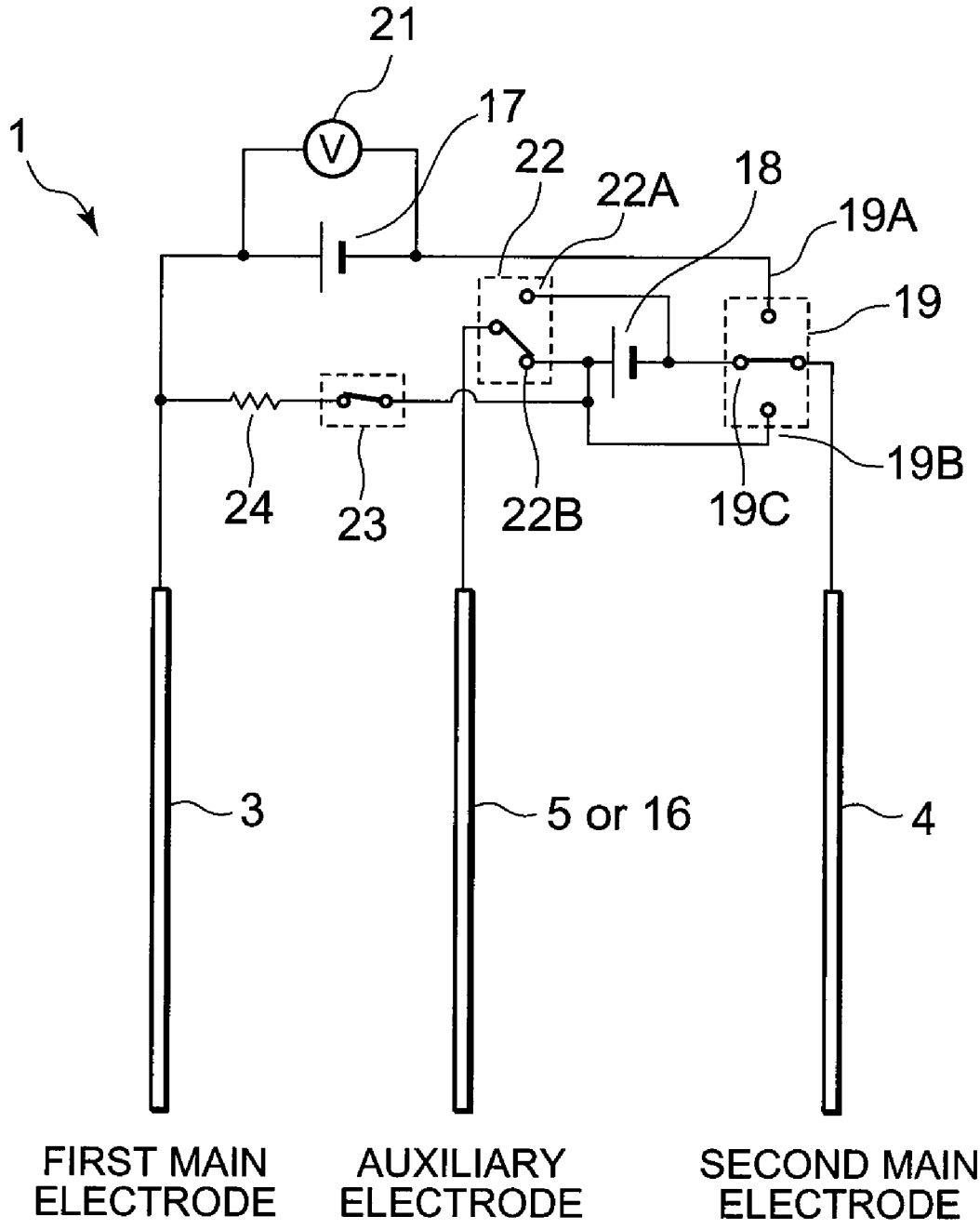
FIG. 11 is a schematic configuration diagram showing a state of the electrolyzing device in a scale removal mode of an auxiliary electrode.

FIG. 1 is a schematic configuration diagram showing an electrolyzing device 1 as an example of the electrolyzing device according to the invention. FIG. 2 is a schematic perspective view showing the electrolyzing device 1 in FIG. 1. FIG. 3 is a schematic top sectional view showing a first main electrode 3. FIG. 4 is a flowchart showing a method of manufacturing the first main electrode 3. FIG. 5 is a schematic configuration diagram showing an electrolyzing device 15 as another example. FIG. 6 is a schematic configuration diagram showing a state of the electrolyzing device 1 in an electrolyzing mode. FIG. 7 is a schematic configuration diagram showing a state of the electrolyzing device 1 in a scale removal mode of a second main electrode. FIG. 11 is a schematic configuration diagram showing a state of the electrolyzing device 1 in a scale removal mode of an auxiliary electrode.

The electrolyzing device 1 according to this embodiment is provided in, for example, a water service pipe where a tap water as treated water flows, and includes a treatment tank 2, a first main electrode 3, a second main electrode 4, an auxiliary electrode 5, and a control part (control means) C.

The treatment tank 2 is configured as a rectangular containing body extending in a longitudinal direction, in which both longitudinal end portions are thinned and both end portions have openings 6 and 7, respectively, through which the treated water flows. One opening 6 is provided with an inflow-side joint 6A connected to an inflow-side water service pipe of the treated water and the other opening 7 is provided with an outflow-side joint 7A connected to an outflow-side water service pipe of the treated water. By connecting the water service pipes to the joints 6A and 7A, respectively, the tap water as the treated water flows to the treatment tank 2.

One inner wall surface of the treatment tank 2 extending in a longitudinal direction is provided with a first main electrode 3 extending in a longitudinal direction, and in the same manner, the other inner wall surface is provided with a second main electrode 4 extending in a longitudinal direction. In the same manner, an auxiliary electrode 5 extending in a longitudinal direction is provided between the first main electrode 3 and the second main electrode 4. Additionally, in this embodiment, the auxiliary electrode 5 is located between the first main electrode 3 and the second main electrode 4 so as to be closer to the second main electrode 4 from the center therebetween.

In the electrolyzing device 1 according to this embodiment, it is desirable that a distance between the first main electrode 3 and the second main electrode 4 is small as much as possible in order to maintain a low voltage from a viewpoint of a consumption electric power or a temperature increase. However, in order to avoid a short circuit caused by scales adhered to an electrode forming a cathode (in this case, the second main electrode 4), it is desirable that the distance is, for example, in a range of 1 to 10 mm. Here, the distance is 10 mm or so. Additionally, it is desirable that a thickness for each of the electrodes 3, 4, and 5 is 1 mm or less.

Here, the first main electrode 3 used as the cathode for reducing an ozone formation potential will be described in detail. As shown in FIG. 3, the first main electrode 3 includes a base body 11, an intermediate layer 12 formed on a surface of the base body 11, and a surface layer 13 formed on a surface of the intermediate layer 12. In this embodiment, the base body 11 is formed of conductive material, for example, valve metal such as platinum (Pt), titanium (Ti), tantalum (Ta), zirconium (Zr), and niobium (Nb), alloy having two or more types of valve metals, or silicon (Si). Particularly, in this embodiment, since it is desirable that the base 11 has a very flat surface, silicon having a flatly treated surface is used.

The intermediate layer 12 is formed of hardly oxidized metal such as platinum or gold (Au), conductive metal oxide such as oxidized iridium, oxidized palladium, oxidized ruthenium or oxide superconductor, or oxidized conductive metal such as silver (Ag), iridium (Ir), palladium (Pd), rhodium (Rh) or ruthenium (Ru) included in platinum group elements. Additionally, as for the metal oxide, it is not limited to a configuration in which the intermediate layer 12 is formed of oxide in advance, but the intermediate layer 12 may be formed of metal oxide oxidized during the electrolyzing treatment. In this embodiment, the intermediate layer 12 is formed of platinum. Additionally, when the base body 11 is formed of platinum, since the surface of the base body 11 is, of course, formed of platinum, it is not necessary to particularly form the intermediate layer 12.

The surface layer 13 functioning as a catalyst formed of dielectric material is formed on the surface of the base body 11 together with the intermediate layer 12 in a layered shape so as to coat the intermediate layer 12. In this embodiment, the surface layer 13 has a predetermined thickness in a range of 0 to 2,000 nm. Additionally, it is more desirable that the thickness of the surface layer 13 is less than 100 nm.

As dielectric material for forming the surface layer 13, oxide titanium, oxide tantalum, oxide tungsten, oxide hafnium, oxide niobium or the like is used.

The surface layer 13 may be formed of oxide containing two or more types of metal elements represented as perovskite oxide such as barium titanate ($BaTiO_3$) or oxide mixture obtained by mixing two or more types of oxide titanium and oxide tantalum having different crystalline structures. In this case, instead of these oxides, oxide mixture containing noble metal or noble metal oxide may be used. Additionally, in this embodiment, although the surface layer 13 is formed of dielectric material, the invention is not limited thereto, but the surface layer 13 may be formed just by mainly containing the dielectric material.

Here, an example of oxide tantalum includes the whole material obtained from a chemical combination between tantalum and oxygen, such as crystalline TaO and $Ta_2O_5$, $TaO_{1-X}$ and $Ta_2O_{5-X}$ in which oxygen loss occurs in the oxides, and indeterminate (amorphous) $TaO_X$. Additionally, an example of oxide titanium includes $TiO_2$, $Ti_2O_3$, TiOx, etc., an example of oxide tungsten includes $WO_3$, WOx, etc., an example of oxide hafnium includes $HfO_2$, $HfO_X$, etc., and an example of oxide niobium includes $Nb_2O_5$, NbOx, etc. Additionally, as dielectric material for forming the surface layer 13, $Al_2O_3$, AlOx, $Na_2O$, NaOx, MgO, MgOx, $SiO_2$, SiOx, $K_2O$, KOx, CaO, CaOx, $Sc_2O_3$, ScOx, $V_2O_5$, VOx, $CrO_2$, CrOx, $Mn_3O_4$, MnOx, $Fe_2O_3$, FeOx, CoO, CoOx, NiO, NiOx, CuO, CuOx, ZnO, ZnOx, GaO, GaOx, $GeO_2$, GeOx, $Rb_2O_3$, RbOx, SrO, SrOx, $Y_2O_3$, YOx, $ZrO_2$, ZrOx, $MoO_3$, MoOx, $In_2O_3$, InOx, $SnO_2$, SnOx, $Sb_2O_5$, SbOx, $Cs_2O_5$, CsOx, BaO, BaOx, $La_2O_3$, LaOx, $CeO_2$, CeOx, $PrO_2$, PrOx, $Nd_2O_3$, NdOx, $Pm_2O_3$, PmOx, $Sm_2O_3$, SmOx, $Eu_2O_3$, EuOx, $Gd_2O_3$, GdOx, $Tb_2O_3$, TbOx, $Dy_2O_3$, DyOx, $Ho_2O_3$, HoOx, $Er_2O_3$, ErOx, $Tm_2O_3$, TmOx, $Yb_2O_3$, YbOx, $Lu_2O_3$, LuOx, $PbO_2$, PbOx, $Bi_2O_3$, BiOx, etc. may be used.

Next, a method of manufacturing the first main electrode 3 will be described with reference to a flowchart shown in FIG. 4. The base body 11 is formed of silicon. At this time, it is desirable that the silicon contains impurities such as phosphorus (P) and boron (B) in order to improve conductivity. The silicon is used, of which a surface is very flat.

First, in Step S1, the silicon base body 11 is subjected to a pre-treatment by using 5% of fluorinated acid so as to remove a natural oxide coating formed on the surface of the silicon substrate 11. Accordingly, the surface of the base body 11 becomes flatter. Additionally, the pre-treatment may not be carried out, but titanium oxide or titanium nitride may be adhered to the surface of the silicon base body 11 so as to improve adhesion of platinum forming the intermediate layer 12 in a rear stage. Subsequently, in Step S2, the surface of the base body 11 is rinsed by purified water. Subsequently, in Step S3, the base body 11 is introduced into a chamber of a general sputter device so as to perform a coating formation.

In this embodiment, the intermediate layer 12 of the base body 11 is formed by an RF sputter method. In this embodiment, since the intermediate layer 12 is formed of platinum, as a first target, Pt (80 mmϕ) as forming material of the intermediate layer is used, and the coating formation is carried out at a room temperature for twenty minutes in a state where an RF power is 100 W, a gas pressure of Ar is 0.9 Pa, and a distance between the base body 11 and the target is 60 mm (Step S3). Accordingly, the intermediate layer 12 having a thickness of 100 nm or so is formed on the surface of the base body 11. Additionally, in this embodiment, although the RF sputter method is used as a method of forming a coating of the intermediate layer 12, the invention is not limited thereto, but for example, a CVD method, a deposition method, an ion coating method, a coating method or the like may be used.

Subsequently, the surface layer 13 is formed on the surface of the base body 11 on which the intermediate layer 12 is formed. In this embodiment, since the surface layer 13 is formed of tantalum, as a target, Ta as a forming material of the surface layer is used, and the coating formation is carried out at a room temperature for twenty minutes in the same condition as described above, that is, in a state where an RF power is 100 W, a gas pressure of Ar is 0.9 Pa, and a distance between the base body and the target is 60 mm (Step S4). Accordingly, the surface layer 13 is formed on the surface of the intermediate layer 12 of the base body 11.

Subsequently, the base body 11, on which the intermediate layer 12 and the surface layer 13 are formed, is subjected to a heat burning (annealing) in a Muffle furnace at 600° C. and at a room temperature for thirty minutes to thereby obtain the first main electrode 3 in Step S5. Accordingly, tantalum metal forming the surface layer 13 and coated on the surface of the intermediate layer 12 is uniformly oxidized. Additionally, in this embodiment, the intermediate layer 12 and the surface layer 13 are formed by the sputter method, and the oxidization treatment of the surface of the electrode 3 is carried out. However, since the oxidization of the electrode surface is carried out upon using the electrode 3 in the electrolyzation state, the heat burning may not be carried out.

The surface layer 13 of the first main electrode 3 obtained in this manner is all oxidized. The intermediate layer 12 forms platinum silicide with silicon of the base body 11. The silicon is stopped in the intermediate layer 12, and hence is not diffused to the inside of the surface layer 13.

Additionally, in the same manner, the platinum forming the intermediate layer 12 does not reach to the inside of the surface layer 13. Meanwhile, the second main electrode 4 is formed of a plate-like insoluble electrode, and is formed of platinum-iridium-based electrolyzing electrode in this embodiment. Additionally, the second main electrode 4 may be formed of an insoluble electrode in which platinum is burned on a surface of a titanium base body, a platinum electrode, a carbon electrode, or the like.

In the same manner as the second main electrode 4, the auxiliary electrode 5 is formed of an insoluble electrode, and is formed of platinum in this embodiment. In the same manner, the auxiliary electrode 5 may be formed of an insoluble electrode in which platinum is burned on a surface of a titanium base body, a platinum-iridium-based electrolyzing electrode, a carbon electrode or the like. Additionally, as described below, when a polarity change between the auxiliary electrode 5 and the second main electrode 4 is not carried out, the auxiliary electrode 5 may be formed of titanium.

The auxiliary electrode 5 according to this embodiment is formed into a plate-like mesh shape capable of ensuring a predetermined water passing property in order not to disturb a flow of the treated water between the first main electrode 3 and the second main electrode 4. Additionally, in this embodiment, the mesh shape is adopted in order not to disturb an operation in which the treated water is electrolyzed by energizing the first main electrode 3 and the second main electrode 4, but the invention is not limited thereto. For example, like an electrolyzing device 15 as another example shown in FIG. 5, an auxiliary electrode 16 may be configured as a plurality of bars (in this case, two bars), a linear wire or a member in which a plurality of water passing holes are formed on a plate-like electrode, so long as the auxiliary electrode 16 has a smaller area contributing to the electrolyzation than those of the first main electrode 3 and the second main electrode 4.

Additionally, in this embodiment, the first main electrode 3 and the second main electrode 5 are formed into the plate-like electrodes, but the invention is not limited thereto. For example, the first main electrode 3 and the second main electrode 5 may be formed into a mesh shape, a plurality of bar shapes, a shape having a plurality of extended lines, or a shape in which a plurality of water-passing holes is formed in a plate-like electrode. In this case, it is possible to efficiently remove bubbles generated from an electrode surface at an electrolyzing time.

The electrodes 3, 4, and 5 are fixed to the treatment container 2, respectively, by use of a fixing tool or a spacer (not shown). Accordingly, each of the electrodes 3, 4, and 5 becomes an unstable state in terms of the treated water flowing to the treatment container 2, thereby preventing a problem that the electrodes come into contact with each other.

As shown in FIG. 6 (FIGS. 7 and 11), the first main electrode 3 is connected to a positive terminal of a second power source 18 via a positive terminal of a first power source 17 and a selection switch 23. The second main electrode 4 is connected to a negative terminal of the first power source 17 via a selection switch 19, and is connected to a positive terminal or a negative terminal of the second power source 18 via the selection switch 19. The auxiliary electrode 5 (or 16) is connected to the positive terminal or the negative terminal of the second power source 18 via a selection switch 22. A voltage meter 21 is connected between the second main electrode 4 and the first main electrode 3 connected to the first power source 17 so as to detect a voltage between both electrodes 3 and 4.

Figure 8:
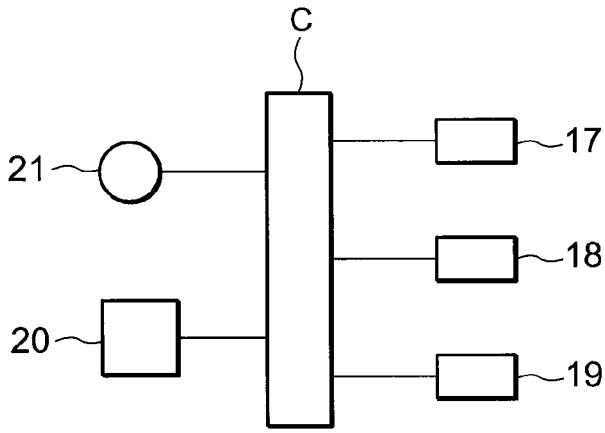
FIG. 8 is an electric block diagram of a control part.

The electrolyzing device 1 according to this embodiment includes a control part C. FIG. 8 shows an electric block diagram of the control part C. The control part C is configured as a universal microcomputer. An input side is connected to a control panel 20 so as to operate the voltage meter 21 or the electrolyzing device 1. On the other hand, an output side is connected to the first power source 17, the second power source 18, the selection switch 19, etc.

With the above-described configuration, the tap water starts to flow into the water service pipe so that a predetermined amount or more of the tap water as the treated water is filled in the treatment container 2. In this state, the control panel 20 is operated to start the electrolyzing mode.

(Electrolyzing Mode)

In the electrolyzing mode, the control part C connects the selection switch 19 to a contact point 19A and connects the selection switch 22 to a contact point 22A. At the same time, the control part C turns ON the first power source 17 and turns off the second power source 18. Accordingly, a positive potential (anode) is applied to the first main electrode 3 and a negative potential (cathode) is applied to the second main electrode 4 so that current density is uniform (FIG. 6).

In general, when a metal electrode is used as an ozone forming electrode, an electrode reaction will take place in the anode when an empty system of the level just above the Fermi level accepts an electron from an electrolyte. In this embodiment, in the first main electrode 3 forming the anode upon being applied with a positive potential, since the surface layer 13 functioning as the catalyst contains the dielectric material as described above, an electrode reaction will take place when an empty system located in the vicinity of the bottom of the conduction band at the energy level higher than the Fermi level by a half of the bandgap. Accordingly, even in a small anode current, for example, 20 $mA/cm^2$, it is possible to high-efficiently form ozone.

Figure 9:
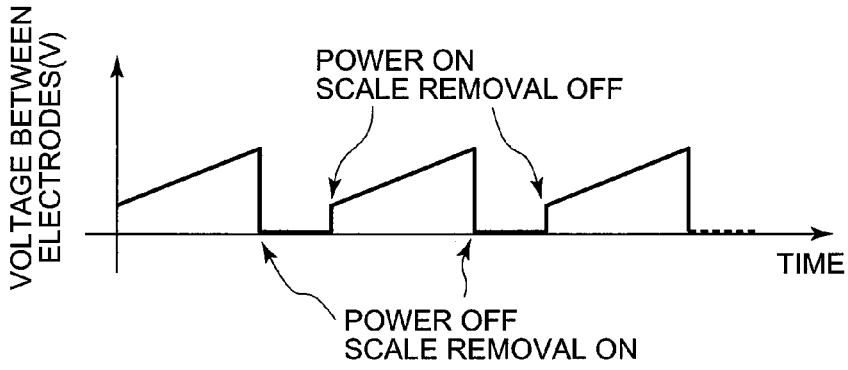
FIG. 9 is a view showing a voltage variation of a first power source in an electrolyzing mode and a scale removal mode of the second main electrode.

Here, FIG. 9 shows a voltage variation of the first power source 17 in the electrolyzing mode and the scale removal mode of the second main electrode described below. In such an electrolyzing mode, since the tap water used as the treated water contains a calcium ion or a magnesium ion, scales mainly containing the calcium or the magnesium are gradually precipitated on the surface of the second main electrode 4 forming the cathode.

At this time, in the electrolyzing mode, since the first power source 17 is controlled at a constant current, when the scales are not adhered to the second main electrode 4 forming the cathode, a voltage variation hardly occurs if the state of the treated water is not changed. However, as the scales are adhered thereto, a voltage increases.

For this reason, the control part C detects the voltage between both electrodes 3 and 4 in the electrolyzing mode at a normal time (or at a predetermined interval) by use of the voltage meter 21, and ends the electrolyzing mode at a time point when the voltage is equal to a predetermined voltage (limitation voltage) to perform the scale removal mode of the second main electrode. Additionally, the limitation voltage corresponds to a voltage at which the current electrolyzing efficiency is smaller than the predetermined electrolyzing efficiency when an amount of the scales adhered to the surface of the second main electrode 4 forming the cathode is a predetermined amount or more.

(Scale Removal Mode of Second Main Electrode)

In the scale removal mode of the second main electrode, the control part C switches the selection switch 19 from the contact point 19A to the contact point 19B, turns on the selection switch 23, turns on the second power source 18, and turns off the first power source 17. A positive electric potential is applied from the second power source 18 to the first main electrode 3 and the second main electrode 4 (anode), and a negative electric potential is applied to the auxiliary electrode 5 (cathode) (FIG. 7).

Here, the reason why the first main electrode 3 is used as the anode is to avoid a problem that a cathode current flows to the first main electrode 3 while being caught in an electric field of the auxiliary electrode 5 and the second main electrode 4 so that the electrode deteriorates and the scales are adhered thereto if the first main electrode 3 is not used as the anode. Additionally, it is desirable that an anode current flowing to the second main electrode is smaller than that flowing to the first main electrode, and it is more desirable that the anode current of the first main electrode 3 is about 0 $mA/cm^2$. Accordingly, a resistor 24 may be interposed between the first main electrode 3 and the second power source 18.

Accordingly, the second main electrode 4 forming the cathode in the electrolyzing mode forms the anode in the scale removal mode of the second main electrode, and the scales adhered to the surface in the electrolyzing mode is removed in terms of melting or separating. Here, in this embodiment, since the platinum-iridium-based electrode is used as the corresponding electrode, when the treated water contains chlorine, the scale removal and the electrolyzation are carried out at the same time, and hypochlorous acid is generated. Additionally, in this scale removal mode, since it is regarded that the scales adhered to the second main electrode 4 can be removed after a predetermined time from a start time, the electrolyzing mode is carried out again.

Figure 10:
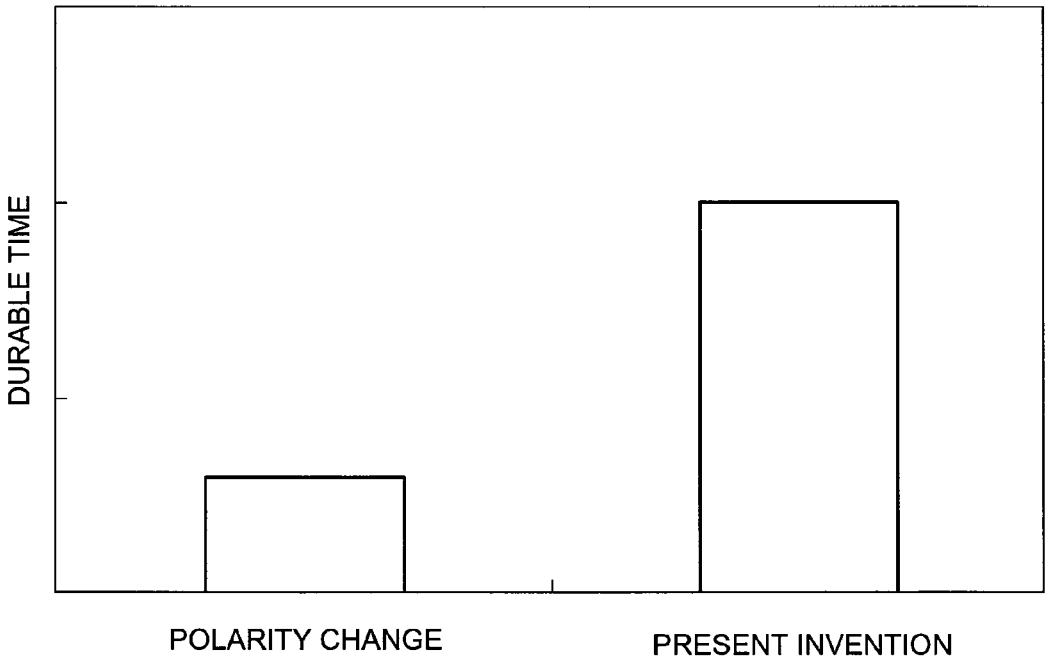
FIG. 10 is a view showing a test result.

Here, FIG. 10 shows an accumulated durable time of the first main electrode 3 in cases where a polarity is simply changed and the present invention is used as a method of removing the scales adhered to the cathode. The durability of each electrode is compared on the basis of an electrolyzing time until a time point when a current electrolyzing ability is smaller than a predetermined electrolyzing ability upon electrolyzing the same treated water in the same condition. At this time, the electrode in use is prepared such that the first main electrode 3 is used as the anode and the second main electrode 4 is used as the cathode in terms of the electrolyzing treatment. Regarding the case where the polarity change is carried out, at every ten minutes, the electrolyzing mode and the scale removal mode for inverting the polarity of the electrode are carried out. In any case, the accumulated durable time is obtained by accumulating the time of the actual treated water in the electrolyzing mode, and the time of the scale removal mode is not included.

According to this, when the scales adhered to the other second main electrode 4 are removed in a state where the first main electrode 3 is used as the cathode, the surface layer 13 mainly containing the dielectric material is apparently destroyed, broken, and separated at an earlier stage. On the contrary, when the first main electrode 3 is just used as the anode, it is understood that the deterioration is less and the durability is more improved than a case where the first main electrode 3 is used as the cathode.

Accordingly, in this embodiment, since the above-described control is carried out, it is possible to electrochemically remove the scales adhered to the second main electrode 4 forming the cathode in the removal mode of the second main electrode without simply changing the polarities of the first main electrode 3 forming the anode and the second main electrode 4 forming the cathode in the electrolyzing mode. For this reason, since it is possible to remove the scales adhered to the second main electrode without particularly using chemicals such as scale removing agents, it is possible to continuously maintain the electrolyzing efficiency of the treated water in the electrolyzing mode.

Additionally, since the first main electrode 3, in which the surface layer 13 mainly containing the dielectric material is formed, is just used as the anode, it is possible to avoid the apparent deterioration generated upon using the first main electrode 3 as the cathode, and thus to improve the durability of the electrode 3.

As described above, according to the invention, even when the first main electrode 3, apparently deteriorating upon being used as the cathode, is used as the electrolyzing electrode, it is possible to efficiently remove the scales of the second main electrode 4 forming the cathode by using the auxiliary electrode 5, and thus to improve the durability of the first main electrode 3 by high-efficiently generating ozone with a simple system.

In this embodiment, since the auxiliary electrode 5 is disposed between the first main electrode 3 and the second main electrode 4, it is possible to more high-efficiently remove the scales adhered to the second main electrode 4 than a case where the auxiliary electrode 5 is disposed in other positions. For this reason, since it is possible to reduce a time necessary for removing the scales, it is possible to improve the electrochemical treatment efficiency as a whole. Additionally, since it is not necessary to provide a mechanism for mechanically scraping off the scales adhered to the second main electrode 4, it is possible to simplify the system.

In this embodiment, since the auxiliary electrode 5 disposed between the first main electrode 3 and the second main electrode 4 is formed into a mesh shape so as to more reduce an area contributing to the electrolyzation than those of the electrodes 3 and 4, even when the auxiliary electrode 5 is disposed between the main electrodes 3 and 4, it is possible to prevent a problem that the auxiliary electrode 5 disturbs the electrochemical treatment of the treated water in the electrolyzing mode. For this reason, like this embodiment, even in a comparatively small-sized device in which a distance between electrodes is narrow, that is, in a range of 1 to 10 mm, it is possible to efficiently remove the scales adhered to the second main electrode 4 without using the first main electrode 3 as the cathode by use of the auxiliary electrode 5 disposed in an advantageous position and formed into an advantageous shape.

In this embodiment, as described above, the control part C moves from the electrolyzing mode to the scale removal mode of the second main electrode when a voltage between both main electrodes 3 and 4 connected to the first power source 17 is equal to a predetermined voltage. For this reason, it is possible to accurately change the mode depending on the precipitation amount of the scales adhered to the second main electrode 4 forming the cathode. Accordingly, it is possible to appropriately change the mode depending on the precipitation state of the scales, and thus to efficiently perform the electrolyzing treatment.

(Scale Removal Mode of Auxiliary Electrode)

By performing the scale removal mode of the second main electrode, the scales are precipitated on the auxiliary electrode 5 forming the cathode. For this reason, in a state where the selection switch 23 is turned on, the control part C connects the selection switch 19 to a contact point 19C and connects the selection switch 22 to a contact point 22B one time of several times of the scale removal mode of the second main electrode or before the end of the scale removal mode of the second main electrode.

Accordingly, since a negative potential is applied to the second main electrode 4 (cathode) and a positive potential is applied to the auxiliary electrode 5 (anode), it is possible to remove the scale adhered to the surface (FIG. 11).

In this mode, the first main electrode 3 is used as the anode. The reason is to prevent such a problem that the cathode current flows to the first main electrode 3 while being caught in the electric field of the auxiliary electrode 5 and the second main electrode 4 so that the electrode deteriorates and the scales are adhered thereto if the first main electrode 3 is not used as the anode. Additionally, it is desirable that the anode current flowing to the first main electrode 3 is smaller than that flowing to the auxiliary electrode, and more desirable that the anode current flowing to the first main electrode 3 is about 0 $mA/cm^2$. Accordingly, the resistor 24 may be interposed between the first main electrode 3 and the second power source 18.

Accordingly, it is possible to efficiently remove the scale adhered to the auxiliary electrode 5 without particularly performing an operation in which the scales adhered to the auxiliary electrode 5 are removed.

Second Embodiment

In the electrolyzing device 1 according to the second embodiment, the points different from the first embodiment will be described, and the same configuration as that of the first embodiment will be appropriately omitted.

Figure 12:
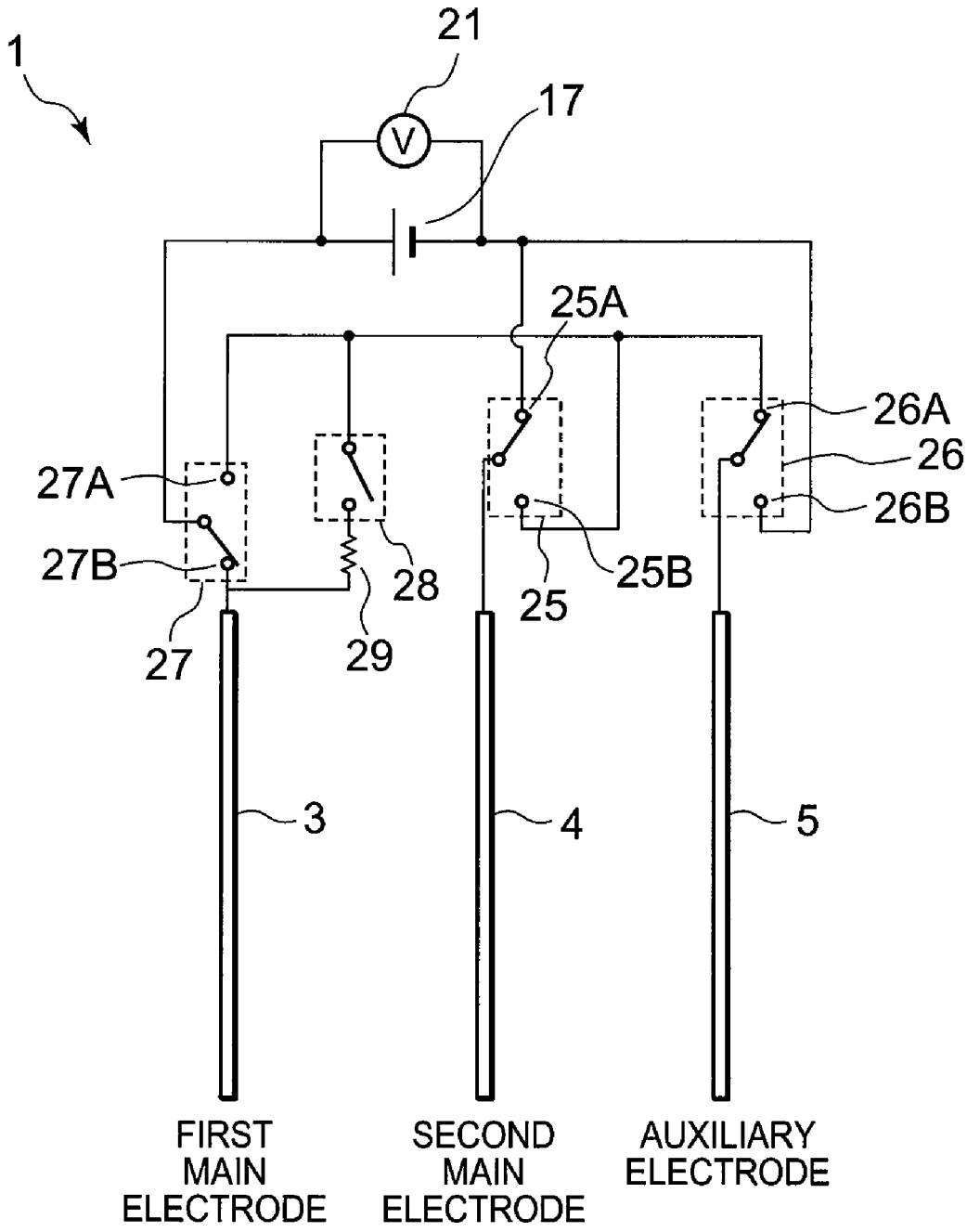
FIG. 12 is a schematic configuration diagram showing a state of the electrolyzing device in the electrolyzing mode according to a second embodiment.
Figure 13:
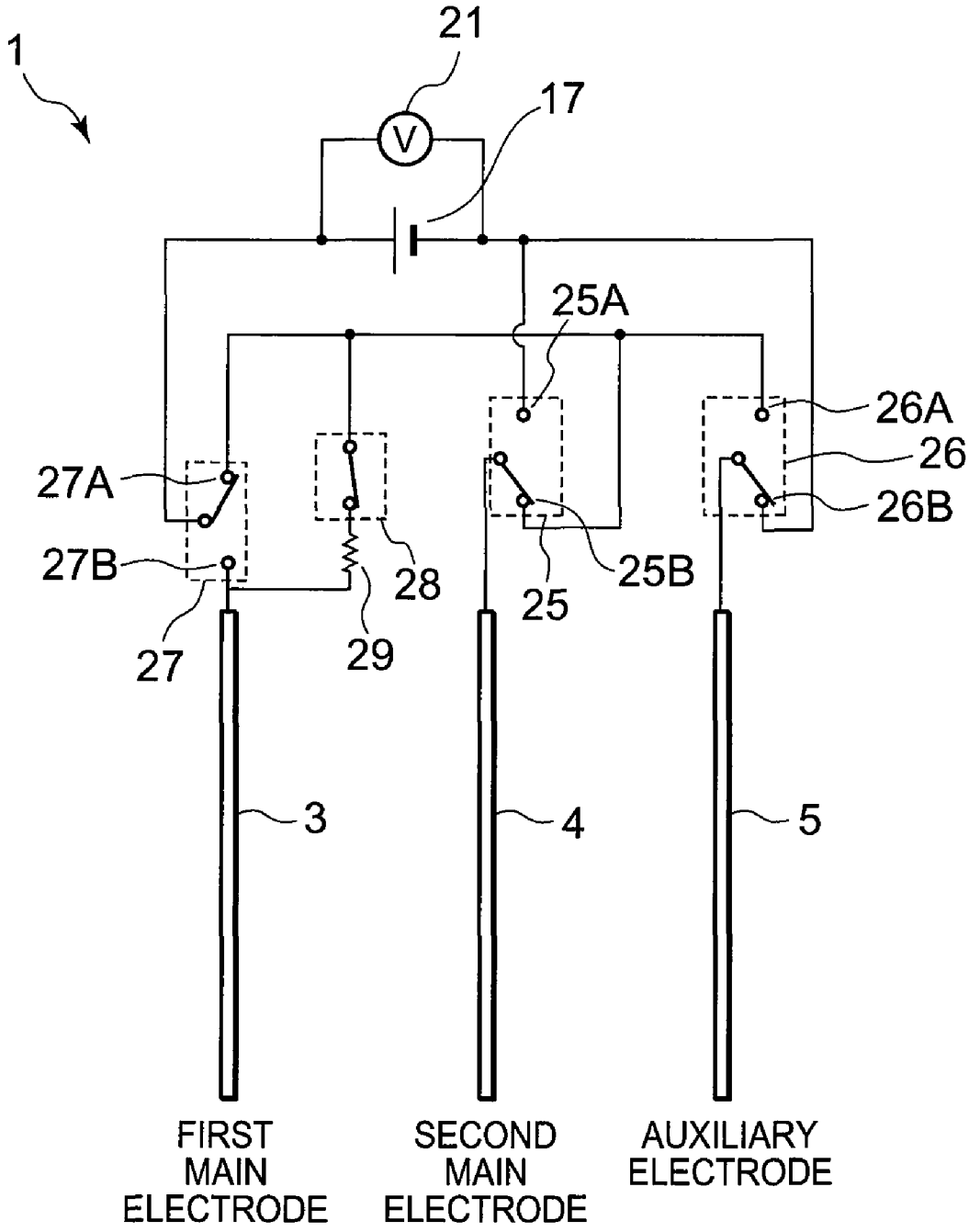
FIG. 13 is a schematic configuration diagram showing a state of the electrolyzing device in the scale removal mode of the second main electrode according to the second embodiment.
Figure 14:
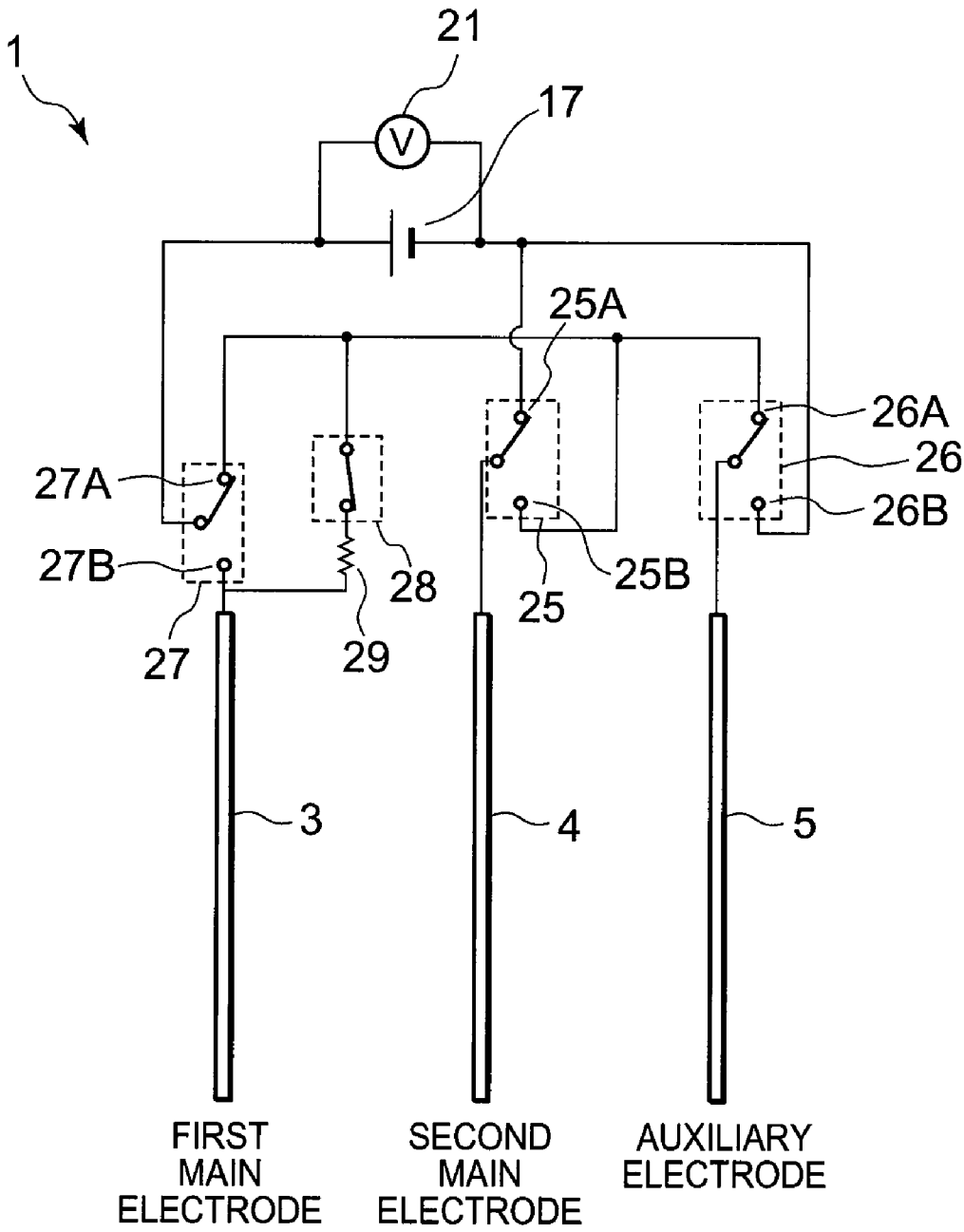
FIG. 14 is a schematic configuration diagram showing a state of the electrolyzing device in the scale removal mode of the auxiliary electrode according to the second embodiment.

In the first embodiment, the auxiliary electrode is disposed between the first main electrode and the second main electrode, but in the second embodiment, the second main electrode is disposed between the first main electrode and the auxiliary electrode. FIG. 12 is a schematic configuration diagram showing a state of the electrolyzing device 1 in the electrolyzing mode, FIG. 13 is a schematic configuration diagram showing a state of the electrolyzing device 1 in the scale removal mode of the second main electrode, and FIG. 14 is a schematic configuration diagram showing a state of the electrolyzing device 1 in the scale removal mode of the auxiliary electrode, respectively.

Unlike the first embodiment, since the electrode is not interposed between the electrodes where the current mainly flows to each other, it is possible to reduce a gap between the electrodes. Accordingly, it is possible to reduce a resistance of the water and to reduce power necessary for the electrolyzation and the scale removal.

Here, the electrodes where the current mainly flows to each other correspond to the first main electrode and the second main electrode in the electrolyzing mode shown in FIG. 12, where the current does not flow to the auxiliary electrode. Also, the electrodes correspond to the second main electrode and the auxiliary electrode in the scale removal mode of the second main electrode shown in FIG. 13, where the anode current flowing to the first main electrode is much smaller than that flowing to the second main electrode so that the cathode current does not flow to the first main electrode 3 while being caught in the electric field of the auxiliary electrode 5 and the second main electrode 4. Also, in the same manner, in the scale removal mode of the auxiliary electrode shown in FIG. 14, the anode current flowing to the first main electrode 3 is much smaller than that flowing to the auxiliary electrode so that the cathode current does not flow to the first main electrode 3.

What is claimed is:

1. An electrolyzing device comprising:
first and second main electrodes;
an auxiliary electrode; and
control means including switches for controlling current supply to the electrodes, wherein:
the first main electrode is an electrode having a property that the electrode deteriorates when used as a cathode,
the electrolyzing device is configured to operate in an electrolyzing mode in which treated water is electrochemically treated, a scale removal mode of the second main electrode in which scales adhered to the second main electrode are removed and a scale removal mode of the auxiliary electrode in which scales adhered to the auxiliary electrode are removed,
the control means is configured:
in the electrolyzing mode, to control the switches to apply a positive potential to the first main electrode to act as an anode and a negative potential to the second main electrode to act as a cathode;
in the scale removal mode of the second main electrode, to control the switches to apply a positive potential to the second main electrode to act as an anode and a negative potential to the auxiliary electrode to act as a cathode; and
in the scale removal mode of the auxiliary electrode, to control the switches to apply a positive potential to the auxiliary electrode to act as an anode and a negative potential to the second main electrode to act as a cathode, and
in the scale removal mode of the second main electrode, the control means further controls the switches to apply a positive potential to the first main electrode to also act as an anode, and controls the electrolyzing device so that an anode current flowing to the first main electrode is smaller than that flowing to the second main electrode.

2. The electrolyzing device according to claim 1, wherein in the scale removal mode of the auxiliary electrode, the control means controls the electrolyzing device so that an anode current flowing to the first main electrode is smaller than that flowing to the auxiliary electrode.

3. The electrolyzing device according to claim 1 or claim 2, wherein the second main electrode is disposed between the first main electrode and the auxiliary electrode.

4. The electrolyzing device according to claim 3, wherein the auxiliary electrode has a smaller area contributing to electrolyzation than those of the first and second main electrodes.

5. The electrolyzing device according to claim 2, wherein the auxiliary electrode has a smaller area contributing to electrolyzation than those of the first and second main electrodes.

6. The electrolyzing device according to claim 1, wherein the auxiliary electrode has a smaller area contributing to electrolyzation than those of the first and second main electrodes.

7. The electrolyzing device according to claim 1, wherein:
the first main electrode includes a surface layer formed on a conductive body, and
the surface layer includes a dielectric material functioning as catalyst.

8. The electrolyzing device according to claim 1, wherein the dielectric material includes titanium oxide, tantalum oxide, tungsten oxide, hafnium oxide or niobium oxide.

9. The electrolyzing device according to claim 1, wherein the first main electrode, the second main electrode and the auxiliary electrode have a plate-like shape and extend along a water flow direction.

10. The electrolyzing device according to claim 1, wherein the auxiliary electrode is disposed between the first main electrode and the second main electrode so as to be closer to the second main electrode than to the first main electrode.

11. The electrolyzing device according to claim 1, wherein the auxiliary electrode has a water passing property so as not to disturb a flow of the treated water between the first main electrode and the second main electrode.

12. The electrolyzing device according to claim 1, wherein an ozone formation potential of the first main electrode deteriorates when used as a cathode.

13. An electrolyzing device comprising:
first and second main electrodes;
an auxiliary electrode; and
means for controlling current supply to the electrodes, wherein:
the first main electrode is an electrode deteriorating upon being used as a cathode,
the electrolyzing device is configured to operate in an electrolyzing mode in which treated water is electrochemically treated, a scale removal mode of the second main electrode in which scales adhered to the second main electrode are removed and a scale removal mode of the auxiliary electrode in which scales adhered to the auxiliary electrode are removed,
the means for controlling controls the electrolyzing device so that:
in the electrolyzing mode, the first main electrode acts as an anode and the second main electrode acts as a cathode;
in the scale removal mode of the second main electrode, the first and second main electrodes act as anodes and the auxiliary electrode acts as a cathode, and an anode current flowing to the first main electrode is smaller than that flowing to the second main electrode; and
in the scale removal mode of the auxiliary electrode, the auxiliary electrode acts as an anode and the second main electrode acts as a cathode.

* * * * *